US010769919B2

(12) United States Patent
Kim

(10) Patent No.: US 10,769,919 B2
(45) Date of Patent: Sep. 8, 2020

(54) ADDITIONAL FUNCTION-EXPANDABLE FIRE DETECTOR

(71) Applicants: WINTECH INFORMATION CO., LTD., Seoul (KR); Ilhwan Kim, Gunpo-si (KR)

(72) Inventor: Ilhwan Kim, Gunpo-si (KR)

(73) Assignees: WINTECH INFORMATION CO., LTD., Seoul (KR); Ilhwan Kim, Gunpo-si (KR)

( * ) Notice: Subject to any disclaimer, the term of this patent is extended or adjusted under 35 U.S.C. 154(b) by 0 days.

(21) Appl. No.: 16/213,252

(22) Filed: Dec. 7, 2018

(65) Prior Publication Data

US 2019/0325724 A1 Oct. 24, 2019

(30) Foreign Application Priority Data

Apr. 20, 2018 (KR) ..... 10-2018-0046020

(51) Int. Cl.
*G08B 17/10* (2006.01)
*G08B 5/36* (2006.01)
*G08B 25/10* (2006.01)

(52) U.S. Cl.
CPC ..... *G08B 17/10* (2013.01); *G08B 5/36* (2013.01); *G08B 25/10* (2013.01)

(58) Field of Classification Search
None
See application file for complete search history.

(56) References Cited

U.S. PATENT DOCUMENTS 3,732,562 A * 5/1973 Faber ..... G08B 26/00 340/505
4,785,284 A * 11/1988 Kimura ..... G08B 26/002 340/505
5,596,314 A * 1/1997 Goldstein ..... G08B 17/103 340/628
6,861,952 B1 * 3/2005 Billmaier ..... G08B 25/009 340/286.02

(Continued)

FOREIGN PATENT DOCUMENTS

JP 2009-199227 A 9/2009
JP 2012-014742 A 1/2012

(Continued)

*Primary Examiner* — Curtis J King
(74) *Attorney, Agent, or Firm* — KORUS Patent, LLC; Seong Il Jeong

(57) ABSTRACT

The present invention relates generally to an additional function-expandable fire detector, and more specifically to an additional function-expandable fire detector that enables an additional function of providing a fire alarm in an early stage to be added through the combination of a semiconductor fire detector with a stand-alone module and also enables only an obsolete fire detector to be replaced in a one-to-one correspondence without the replacement of an overall existing fire detection system. The additional function-expandable fire detector includes: a body; a contactless output circuit unit that is installed in the body, that directly detects a fire, and that outputs an optical signal to the outside; and a stand-alone module that is coupled to the body, that detects the optical signal of the contactless output circuit unit, and that provides notification of the fire.

6 Claims, 5 Drawing Sheets

(56) References Cited

U.S. PATENT DOCUMENTS

| | | | | |
|---|---|---|---|---|
| 8,004,416 | B2 * | 8/2011 | Bradley, Jr. | G08B 17/113 340/628 |
| 2006/0202849 | A1 * | 9/2006 | Cook | G08B 17/10 340/693.7 |
| 2011/0038126 | A1 * | 2/2011 | Casey | G08B 17/10 361/729 |
| 2011/0080296 | A1 * | 4/2011 | Lance | G08B 17/06 340/578 |
| 2012/0210785 | A1 * | 8/2012 | Casey | G08B 17/10 73/431 |
| 2013/0201024 | A1 * | 8/2013 | Greenwood | G08B 17/10 340/628 |
| 2014/0104067 | A1 * | 4/2014 | Chien | G08B 17/10 340/628 |
| 2015/0145684 | A1 * | 5/2015 | Schmid | G08B 17/10 340/628 |
| 2015/0181741 | A1 * | 6/2015 | Stagg | G08B 17/10 361/731 |
| 2016/0217682 | A1 * | 7/2016 | Brigham | G08B 17/06 |
| 2016/0225243 | A1 * | 8/2016 | Albass | G08B 17/10 |
| 2016/0240058 | A1 * | 8/2016 | Brigham | G08B 17/06 |
| 2016/0334082 | A1 * | 11/2016 | Chen | F21V 17/002 |
| 2019/0066483 | A1 * | 2/2019 | Darling | G08B 25/10 |

FOREIGN PATENT DOCUMENTS

| | | | |
|---|---|---|---|
| JP | 2015-094982 | A | 5/2015 |
| JP | 2018-055531 | A | 4/2018 |
| KR | 10-2001-0051578 | A | 6/2001 |
| KR | 10-2009-0120032 | A | 11/2009 |
| KR | 10-0938591 | B1 | 1/2010 |
| KR | 10-1497539 | B1 | 3/2015 |
| KR | 10-1739543 | B1 | 5/2017 |

* cited by examiner

ADDITIONAL FUNCTION-EXPANDABLE FIRE DETECTOR

CROSS-REFERENCE TO RELATED APPLICATION

This application claims the benefit of Korean Patent Application No. 10-2018-0046020 filed on Apr. 20, 2018, which is hereby incorporated by reference herein in its entirety.

BACKGROUND

1. Technical Field

The present invention relates generally to an additional function-expandable fire detector, and more specifically to an additional function-expandable fire detector that enables an additional function of providing a fire alarm in an early stage to be added through the combination of a semiconductor fire detector with a stand-alone module and also enables only an obsolete fire detector to be replaced in a one-to-one correspondence without the replacement of an overall existing fire detection system.

2. Description of the Related Art

Conventional fire detectors (or conventional fire alarms) are apparatuses that prompt rapid evacuation by detecting the occurrence of a fire by using temperature and smoke concentration increasing due to the occurrence of the fire and providing notification of the occurrence of the fire to people in a building in the form of sound or light.

The condition under which a fire detector determines that a fire occurs is that a temperature is equal to or higher than 70° C. or a smoke concentration is equal to or higher than 30%, as stipulated by the Fire Services Act. In this case, the fire detector issues a fire alarm. However, there is no provision for a method for detecting the occurrence of a fire in its early stage and taking countermeasures against the fire when the fire occurs actually, and thus the occurrence of the fire is detected late, with the result that damage attributable to the fire increases.

If a temperature lower than the temperature stipulated in the Fire Services Act, i.e., 40° C., 45° C., 50° C., or the like, or a smoke concentration lower than the smoke concentration stipulated in the Fire Services Act, i.e., 5%, 10%, 15%, 20%, or the like, is detected and a preliminary fire alarm is issued in an early stage, a period during which countermeasures against a fire can be taken is increased, and thus the opportunity and period for reducing damage attributable to the fire are increased. However, currently, a fire detector having a function of issuing a preliminary fire alarm is not approved under the Fire Services Act, and thus it is difficult to apply such a fire detector.

Furthermore, there is a need for a means for monitoring and managing the states of a plurality of fire detectors in a single place or at a glance via a smartphone, the multi-screen system of a fire station, a control room, or the like through the combination of a preliminary alarm function with another function, such as an Internet-of-Things (IoT) function. However, it is difficult to apply a method suitable for the Fire Services Act and type approval conditions, and thus it is difficult or impossible to provide such a means.

Moreover, an existing fire detector is obsolete and suffers from aged deterioration, and thus damage increases due to frequent erroneous operation or no operation when a fire occurs actually. In order to reduce such damage, the newly established Fire Services Act stipulates that an individual house or multi-household house should be equipped with a stand-alone fire detector.

The stand-alone fire detector has a function of issuing its own alarm in case of fire. If an alarm is silenced by an alarm system due to the frequent erroneous operation of the fire detector, there is a lack of a means for delivering an alarm to other neighbors in a populated condition. Meanwhile, although a wireless stand-alone fire alarm has been newly stipulated, it needs to be separately installed without connection with existing fire detection equipment, and thus a problem arises in that the existing fire detection equipment is taken into account and dual investment is required.

As related art related to the above problems, Korean Patent No. 10-1739543 discloses a multipurpose fire alarm apparatus including: a firefighting equipment unit that is installed in a fire protection range of a building, that issues an alarm for the occurrence of a fire within the fire protection range in response to a predetermined control signal, and that operates smoke removal equipment, spring cooler equipment, auxiliary equipment, and alarm equipment installed in the building; a multipurpose fire detection unit that includes a main detection module configured to provide primary detection data used to primarily determine whether a fire occurs within the fire protection range, an auxiliary detection module configured to provide secondary detection data used to secondarily determine whether a fire occurs, and another information detection module configured to provide another type of detection data that is not directly related to the determination of whether a fire occurs, and that transmits the detected primary detection data, secondary detection data and the other type of detection data to the outside; and a multipurpose firefighting control unit that determines whether a fire occurs within the fire protection range by receiving and analyzing the primary detection data and the secondary detection data, and that issues a fire alarm by transmitting a predetermined type of fire processing packet when, as a result of the determination, it is determined that a fire occurs within the fire protection range, and that issues an emergency alarm when, as a result of the analysis of the other detection data, it is determined that an emergency, other than a fire, occurs.

The related art is problematic in that equipment cost increases because a system for performing the functions provided in the fire detector needs to be newly constructed, and is also problematic in that it is difficult to detect the occurrence of a fire in its early stage and issue a preliminary fire alarm because the related art is intended to simply increase the accuracy of the detection of a fire.

SUMMARY

The present invention has been conceived to overcome the above-described problems, and an object of the present invention is to provide a fire detector that, by using a semiconductor fire detector approved under the Fire Services Act, enables an existing fire detector to be replaced in a one-to-one correspondence and also enables an additional function to be easily added without the violation of the Fire Services Act.

According to an aspect of the present invention, there is provided an additional function-expandable fire detector, including: a body; a contactless output circuit unit that is installed in the body, that directly detects a fire, and that outputs an optical signal to the outside; and a stand-alone module that is coupled to the body, that detects the optical signal of the contactless output circuit unit, and that provides notification of the fire.

The contactless output circuit unit may include: a power input unit that receives power; a sensor unit that detects a fire phenomenon by using the power of the power input unit; an operation monitoring unit that monitors the input power of the power input unit and the breakdown of the sensor unit; a fire determination unit that determines whether a fire occurs by using the measured value of the sensor unit; a preliminary fire determination unit that determines the occurrence of a preliminary fire by using the measured value of the sensor unit; a switching unit that issues a fire alarm by short-circuiting the input power in response to a fire signal of the fire determination unit; an operating state LED unit that outputs an optical signal to the outside via a signal of the operation monitoring unit; an alarm issuance LED unit that outputs an optical signal to the outside according to an operation of the switching unit; and a preliminary alarm LED unit that outputs an optical signal to the outside via a signal of the preliminary fire determination unit.

The stand-alone module may include: an operating state reception unit that detects whether or not the operating state LED unit is turned on; an alarm reception unit that detects whether or not the alarm issuance LED unit is turned on; a preliminary alarm reception unit that detects whether or not the preliminary alarm LED unit is turned on; and an integrated transmission unit that provides the detection situations of the reception units to the outside in real time.

When the stand-alone module is combined with the body, the reception units may be disposed to face the respective LED units having corresponding functions in a one-to-one correspondence.

The integrated transmission unit may include an alarm output unit that provides direct notification to the outside in the form of an alarm sound, voice, or siren.

The integrated transmission unit may include a remote communication unit that transmits notification to a remote terminal via wired communication or wireless communication.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Embodiments of the present invention will be described in detail below with reference to the accompanying drawings. Furthermore, in the following description of the present invention, when it is determined that a detailed description of a related well-known function or configuration may unnecessarily make the gist of the present invention obscure, the detailed description will be omitted.

Figure 1:
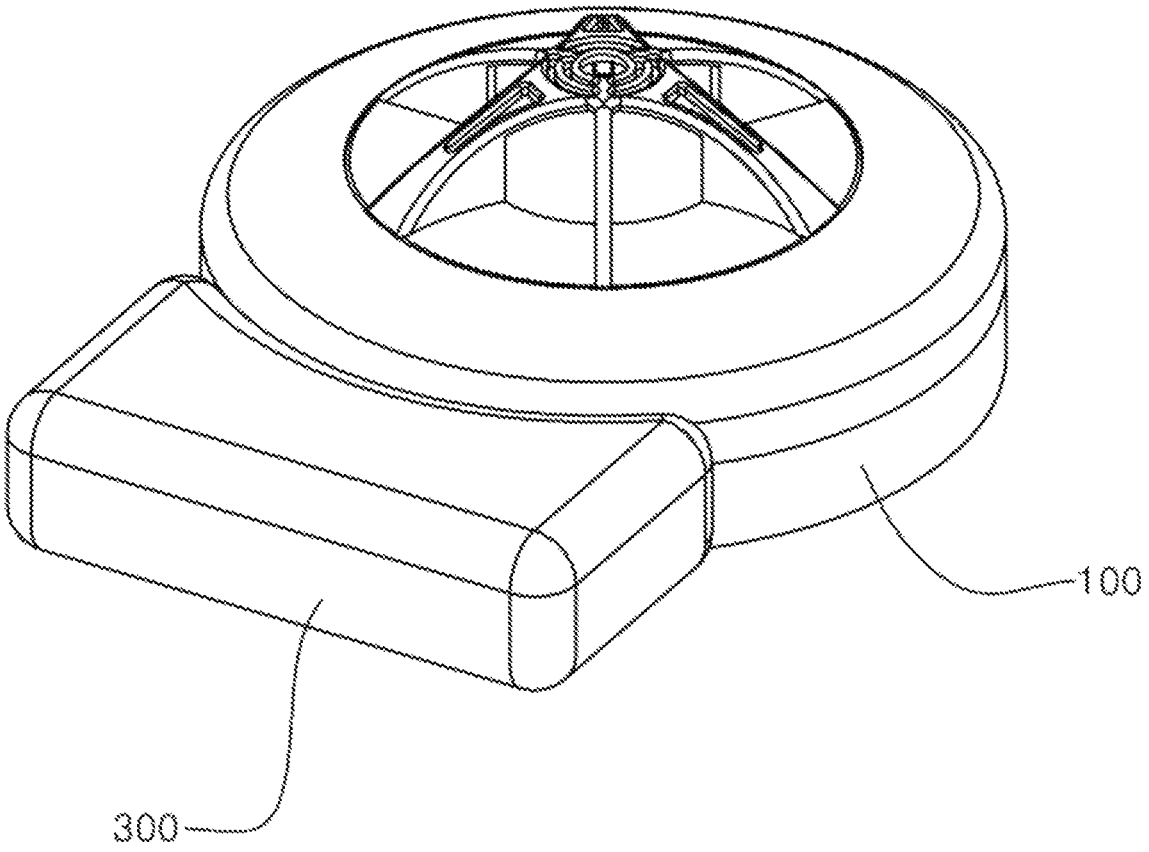
FIG. 1 is a perspective view showing an additional function-expandable fire detector according to the present invention.
Figure 2:
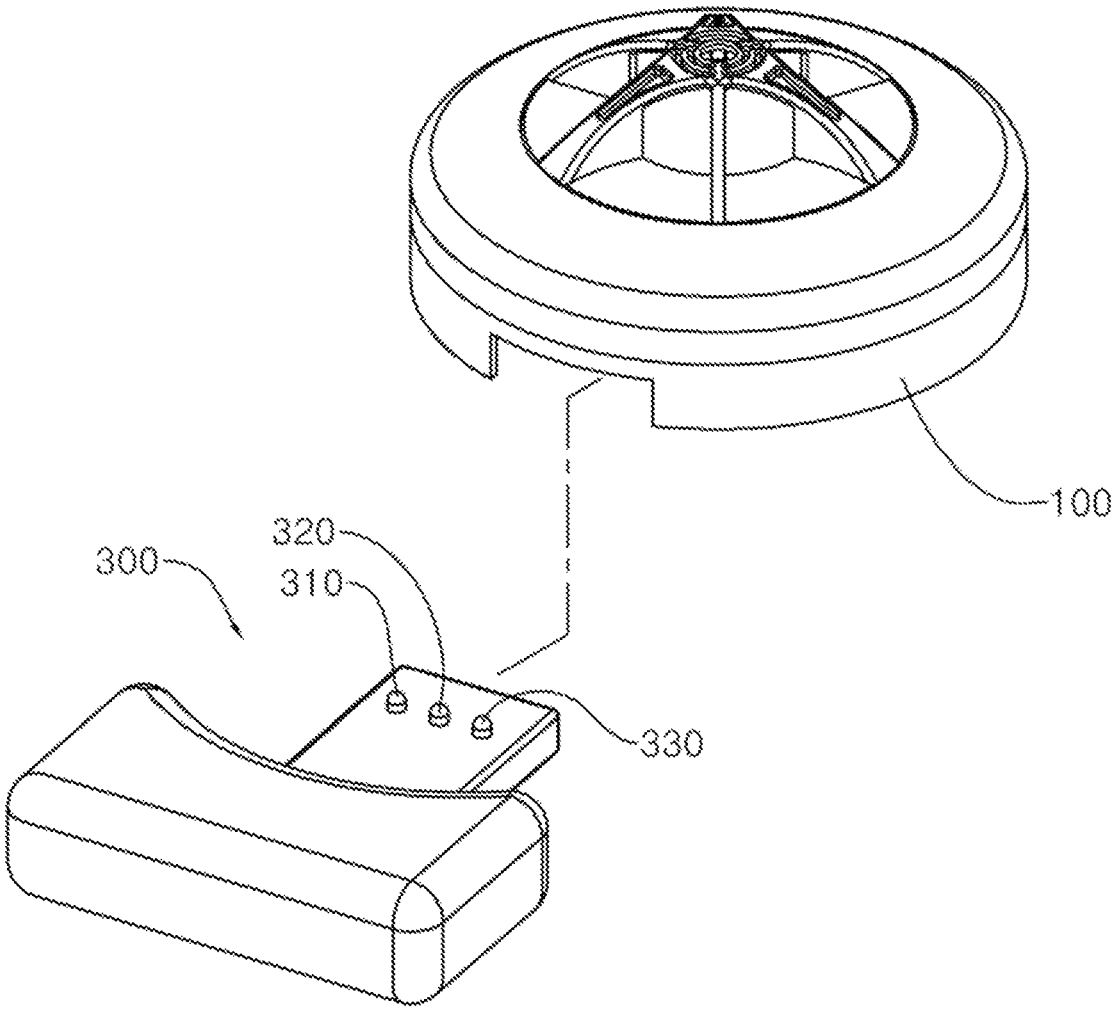
FIG. 2 is an exploded perspective view showing a body and a stand-alone module according to the present invention.
Figure 3:
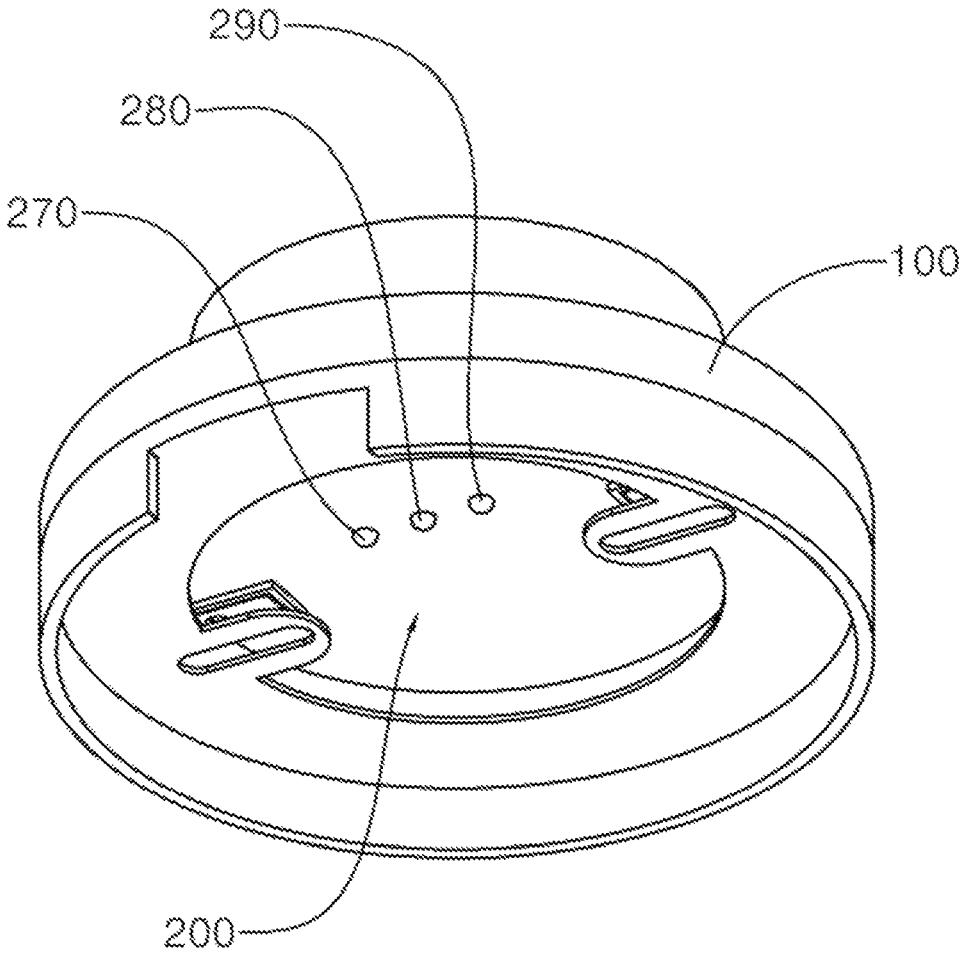
FIG. 3 is a perspective view showing the optical signal output components of a contactless output circuit unit provided on the bottom surface of the body according to the present invention.

An additional function-expandable fire detector according to the present invention is directed to a semiconductor fire detector. As shown in FIGS. 1 to 3, the additional function-expandable fire detector includes: a body 100; a contactless output circuit unit 200 installed in the body 100, and configured to directly detect a fire and to output an optical signal to the outside; and a stand-alone module 300 coupled to the body 100, and configured to detect the optical signal of the contactless output circuit unit 200 and to provide notification of the fire.

The body 100 forms the appearance of the fire detector. Although the body 100 may be formed in various shapes, the body 100 is formed in the present embodiment in a shape in which a portion through which the stand-alone module 300 is inserted into the body 100 is formed in one side thereof so that the stand-alone module 300 is easily combined with and separated from the body 100.

The contactless output circuit unit 200 according to the present invention generates a fire alarm signal based on measured sensing information, thereby enabling an alarm action and countermeasures to be immediately taken, and determines whether to issue a preliminary alarm, whether to issue a fire alarm, and whether or not the fire detector operates normally, thereby enabling LED light, varying depending on the situation, to be output to the outside.

The contactless output circuit unit 200 may be used for an existing fire detector without being combined with the stand-alone module 300. Accordingly, a fire alarm is issued at the fire temperature (which is currently stipulated at 70° C.) stipulated by the Fire Services Act, and only LED light is emitted without performing an alarm function in connection with the additional function. Therefore, it may be possible to receive the type approval of the fire detector while observing the provisions of the Fire Services Act without being combined with the stand-alone module 300. Moreover, it may be used without damaging an existing system including a plurality of fire detectors, and thus an advantage arises in that only an obsolete fire detector may be selected and replaced in a one-to-one correspondence.

The stand-alone module 300 according to the present invention is configured to be freely combined with and separated from the body 100. The stand-alone module 300 is not electrically connected to the contactless output circuit unit 200, and performs additional functions related to the termination of whether to issue a preliminary fire alarm, whether to issue a fire alarm, and whether or not the fire detector operates normally by detecting only an output optical signal via a detection element such as a photosensor.

The configurations of the contactless output circuit unit 200 and the stand-alone module 300 will be described in detail below with reference to the accompanying drawings.

Figure 4:
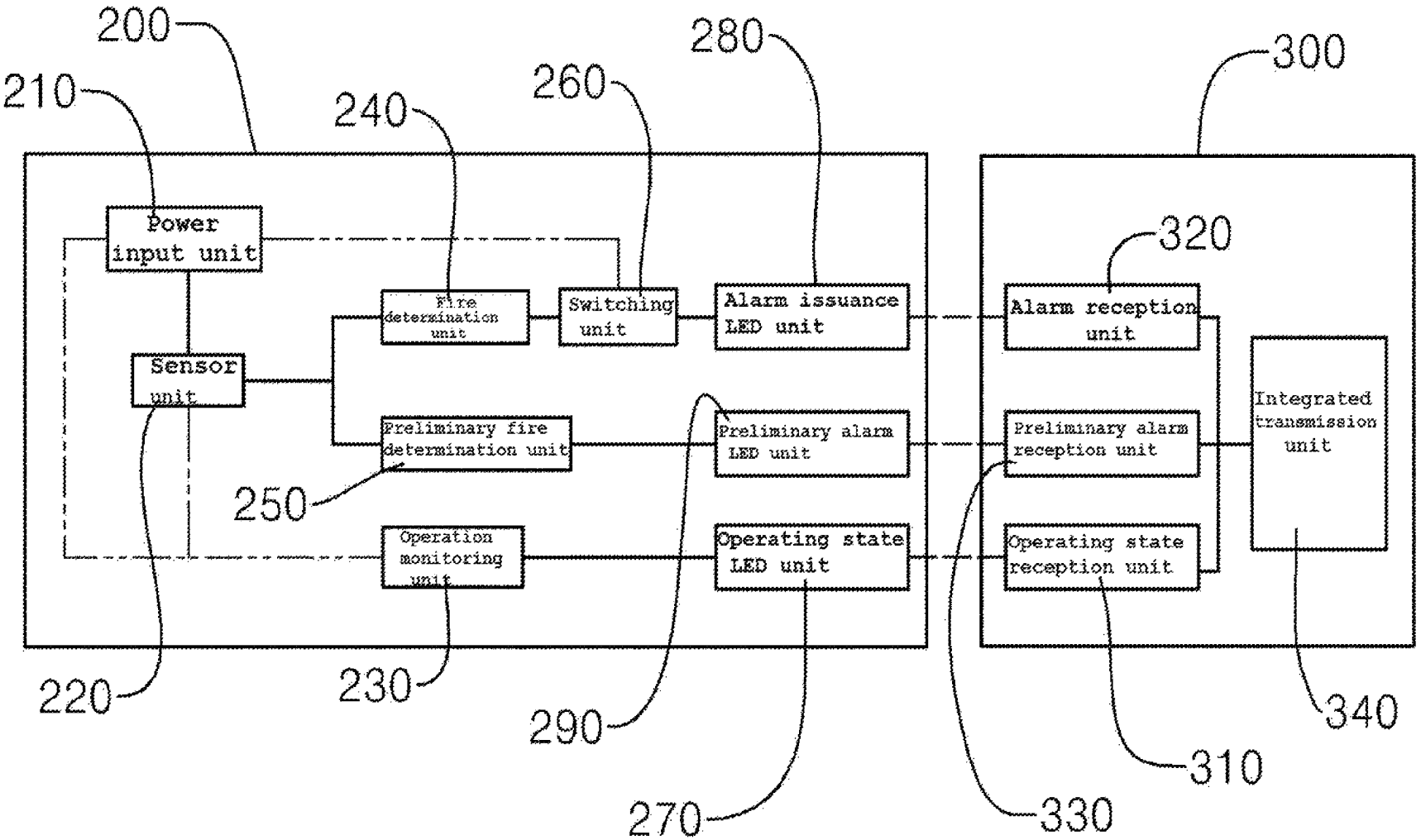
FIG. 4 is a diagram showing the components of the contactless output circuit unit and the components of the stand-alone module according to the present invention.
Figure 5:
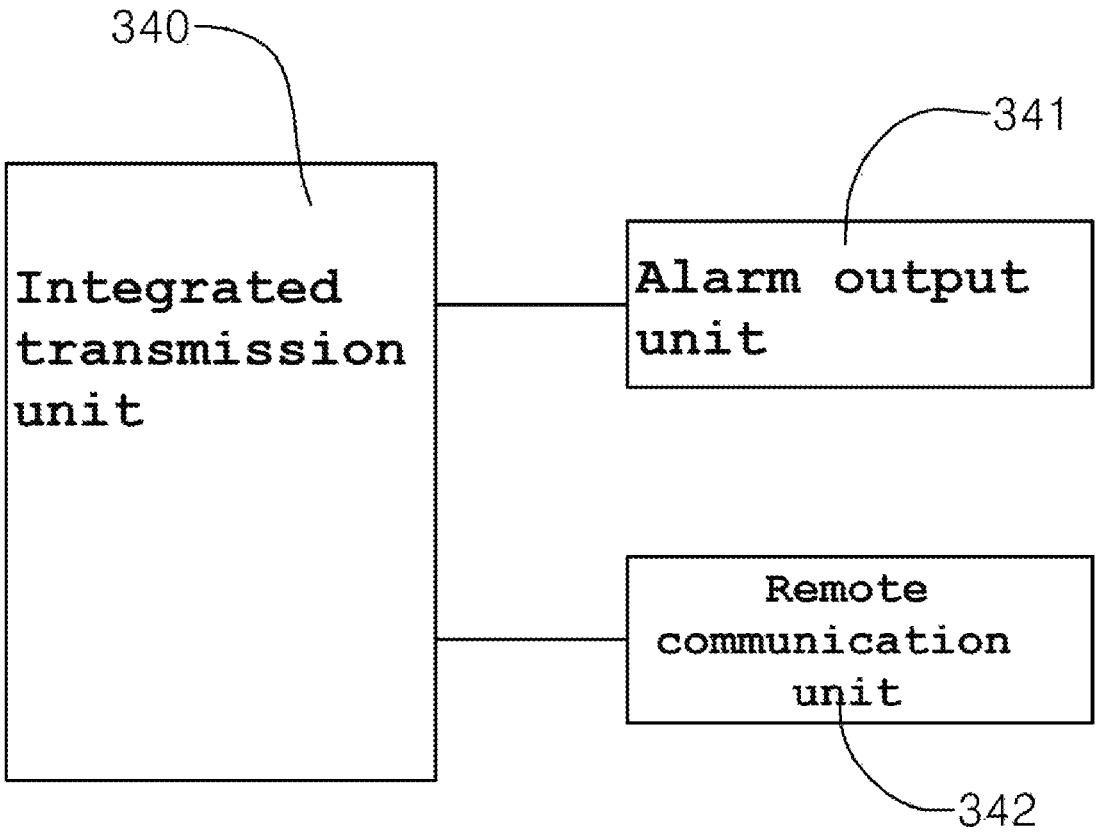
FIG. 5 is a diagram showing the configuration of an integrated transmission unit according to the present invention.

As shown in FIG. 4, the contactless output circuit unit 200 according to the present invention includes: a power input unit 210 configured to receive power; a sensor unit 220 configured to detect a fire phenomenon by using the power of the power input unit 210; an operation monitoring unit 230 configured to monitor the input power of the power input unit 210 and the breakdown of the sensor unit 220; a fire determination unit 240 configured to determine whether a fire occurs by using the measured value of the sensor unit 220; a preliminary fire determination unit 250 configured to determine the occurrence of a preliminary fire by using the measured value of the sensor unit 220; a switching unit 260 configured to issue a fire alarm by short-circuiting the input power in response to a fire signal of the fire determination unit 240; an operating state LED unit 270 configured to output an optical signal to the outside via a signal of the operation monitoring unit 230; an alarm issuance LED unit 280 configured to output an optical signal to the outside according to the operation of the switching unit 260; and a preliminary alarm LED unit 290 configured to output an optical signal to the outside via a signal of the preliminary fire determination unit 250.

The power input unit 210 supplies power to the contactless output circuit unit 200 by using a 24 V DC power source. In this case, the power input unit 210 reduces source power to a required voltage via a separate power conversion unit, and supplies the reduced voltage to the sensor unit 220.

Furthermore, the sensor unit 220 detects a phenomenon that occurs when a fire occurs. Although the sensor unit 220 preferably detects a temperature or smoke concentration, it will be apparent that various types of detection, such as flame detection, gas detection, earthquake detection, radioactivity detection, etc., may be performed. For ease of description, descriptions of the sensor unit 220 according to the present invention and related configurations will be given using a temperature sensor, which is the most commonly used, as an example.

The operation monitoring unit 230 monitors whether the fire detector is operating normally by monitoring the input power of the power input unit 210 and the breakdown of the sensor unit 220. In other words, the operation monitoring unit 230 monitors whether the power of the fire detector is cut off by an administrator or whether the sensor unit 220 breaks down.

The fire determination unit 240 performs determination by using a temperature value measured by the sensor unit 220. In greater detail, the fire determination unit 240 determines that a fire occurs when the measured temperature value exceeds 70° C. corresponding to a preset temperature value. The set temperature value is a temperature value stipulated for the issuance of a fire alarm by the Fire Services Act, and is currently set to 70° C. Accordingly, the set temperature value may not be changed by an administrator as desired.

Furthermore, the preliminary fire determination unit 250 also performs determination by using a temperature value measured by the sensor unit 220, and is used for the issuance of a preliminary alarm. Since the preliminary alarm needs to be issued before the issuance of a fire alarm, a reference temperature is set to a temperature equal to or lower than 70° C. corresponding to the set temperature value of the fire determination unit 240, and may be preferably set to 50° C. or 60° C. As described above, the reference temperature of the preliminary fire determination unit 250 may be set to an appropriate temperature by an administrator.

The switching unit 260 issues a fire alarm by short-circuiting input power in response to the fire signal of the fire determination unit 240. Although a fire alarm used by the conventional fire detectors is issued by a physical short circuit caused simply by melting attributable to heat, a fire alarm is issued by a short circuit caused by the control of the switching unit 260 in the present invention.

The operating state LED unit 270, the alarm issuance LED unit 280, and the preliminary alarm LED unit 290 according to the present invention are installed to be exposed out of the body 100, as shown in FIG. 3.

The operating state LED unit 270 receives a signal from the operation monitoring unit 230, and outputs an optical signal to the outside in the form of light. The operating state LED normally remains on. When the breakdown of the sensor unit 220 occurs or the power of the fire detector is cut off by an administrator, the operating state LED is turned off.

When the switching unit 260 operates in order to issue a fire alarm, the alarm issuance LED unit 280 outputs an optical signal to the outside in the form of light. Furthermore, the preliminary alarm LED unit 290 outputs an optical signal via a signal of the preliminary fire determination unit 250. The alarm issuance LED unit 280 and the preliminary alarm LED unit 290 normally remain off, and the LEDs thereof are turned on only in case of a fire alarm or preliminary fire alarm.

The alarm issuance LED unit 280 outputs an optical signal after a fire alarm has been issued by the switching unit 260, whereas the preliminary alarm LED unit 290 and the operating state LED unit 270 output only optical signals intended to provide notification to the outside. The optical signals are received by the stand-alone module 300 that is combined with the body 100.

As shown in FIG. 4, the stand-alone module 300 according to the present invention includes: an operating state reception unit 310 configured to detect whether or not the operating state LED unit 270 is turned on; an alarm reception unit 320 configured to detect whether or not the alarm issuance LED unit 280 is turned on; a preliminary alarm reception unit 330 configured to detect whether or not the preliminary alarm LED unit 290 is turned on; and an integrated transmission unit 340 configured to provide the detection situations of the reception units to the outside in real time.

The operating state reception unit 310, the alarm reception unit 320, and the preliminary alarm reception unit 330 are sensors that are installed to be exposed out of the stand-alone module 300. When the stand-alone module 300 is combined with the body 100, the reception units 310, 320 and 330 are disposed to face the respective LED units 270, 280 and 290 having corresponding functions in a one-to-one correspondence, and detect whether or not the corresponding LED units 270, 280 and 290 are turned on.

Although the reception units 310, 320 and 330 have been described as obtaining information by detecting whether or not the corresponding LED units 270, 280 and 290 are turned on in the present embodiment, such information may be obtained using the color of light or the interval at which light flickers by supplementing the performance of the reception units configured to detect light and a program configured to output the optical signals of the LED units, integrating the plurality of reception units into a single reception unit, and also integrating the plurality of LED units into a single LED unit.

The integrated transmission unit 340 may include an alarm output unit 341 configured to provide direct notification to the outside in the form of an alarm sound, voice, or siren. The alarm sound or voice alarm of the alarm output unit 341 may be provided via its own speaker.

As examples of such a voice alarm, the alarm of the operating state reception unit 310 may be "An abnormality occurs in the fire detection system" or "Please replace the battery with a new one," the alarm of the alarm reception unit 320 may be "A fire is detected. Please evacuate quickly," and the alarm of the preliminary alarm reception unit 330 may be "An abnormally high temperature is detected. Please check around quickly."

Furthermore, when the integrated transmission unit 340 further includes a remote communication unit 342 configured to transmit information to a remote terminal via wired communication or wireless communication such as or Bluetooth, Wi-Fi, ZigBee, or LoRa, the detection situations of the respective reception units may be received by the terminal of an administrator, the multi-screen system of a fire station, a control room, or the like, in which case a plurality of pieces of fire detector information may be monitored at a glance.

When in connection with the components responsible for a function of issuing a preliminary fire alarm, the set value of the preliminary fire determination unit 250 is subdivided into 40° C., 50° C., and 60° C. and first, second, and third preliminary alarm LED units and first, second, and third preliminary alarm reception units are provided, an advantage arises in that stepwise preliminary fire alarms may be issued, and stepwise countermeasures for the stepwise preliminary fire alarms may be taken.

According to the present invention, a preliminary alarm function that has not been approved under the Fire Services Act is added via the contactless output circuit unit and the detachable stand-alone module, and thus the advantage of minimizing accidents that may occur due to the delay of fire evacuation is achieved.

Furthermore, according to the present invention, only an obsolete fire detector is replaced in a one-to-one correspondence without the replacement of an existing fire detection system, and thus the advantage of reducing facility cost is achieved.

Moreover, according to the present invention, various additional functions may be conveniently added through the upgrading of the contactless output circuit unit and the detachable stand-alone module and a plurality of fire detectors may be conveniently checked and monitored in an integrated manner by combining an additional function with IoT technology, and thus the advantage of constructing an advanced fire detection system is achieved.

While the present invention has been described with reference to the embodiment, it will be apparent that various modifications and alterations may be made within the scope of the technical spirit of the present invention.

What is claimed is:

1. An additional function-expandable fire detector, comprising:

a body (100);

a contactless output circuit unit (200) that is installed in the body (100), that directly detects a fire, and that outputs an optical signal to an outside; and a stand-alone module (300) that is coupled to the body (100), that detects the optical signal of the contactless output circuit unit (200), and that provides notification of the fire;

wherein the contactless output circuit unit (200) comprises:

a power input unit (210) that receives power;

a sensor unit (220) that detects a fire phenomenon by using the power of the power input unit (210);

an operation monitoring unit (230) that monitors input power of the power input unit (210) and breakdown of the sensor unit (220);

a fire determination unit (240) that determines whether a fire occurs by using a measured value of the sensor unit (220);

a preliminary fire determination unit (250) that determines an occurrence of a preliminary fire by using the measured value of the sensor unit (220);

a switching unit (260) that issues a fire alarm by short-circuiting the input power in response to a fire signal of the fire determination unit (240);

an operating state LED unit (270) that outputs a first optical signal to the outside via a signal of the operation monitoring unit (230);

an alarm issuance LED unit (280) that outputs a second optical signal to the outside according to an operation of the switching unit (260); and a preliminary alarm LED unit (290) that outputs a third optical signal to the outside via a signal of the preliminary fire determination unit (250).

2. The additional function-expandable fire detector of claim 1, wherein the stand-alone module (300) comprises:

an operating state reception unit (310) that detects whether or not the operating state LED unit (270) is turned on;

an alarm reception unit (320) that detects whether or not the alarm issuance LED unit (280) is turned on;

a preliminary alarm reception unit (330) that detects whether or not the preliminary alarm LED unit (290) is turned on; and an integrated transmission unit (340) that provides detection situations of the reception units to the outside in real time.

3. The additional function-expandable fire detector of claim 2, wherein when the stand-alone module (300) is combined with the body (100), the reception units (320, 330, and 340) are disposed to face the respective LED units (270, 280 and 290) having corresponding functions in a one-to-one correspondence.

4. The additional function-expandable fire detector of claim 2, wherein the integrated transmission unit (340) comprises an alarm output unit (341) that provides direct notification to the outside in a form of an alarm sound, voice, or siren.

5. The additional function-expandable fire detector of claim 2, wherein the integrated transmission unit (340) comprises a remote communication unit (342) that transmits notification to a remote terminal via wired communication or wireless communication.

6. The additional function-expandable fire detector of claim 5, wherein the remote communication unit (342) performs the wireless communication with the remote terminal via RF wireless communication, Wi-Fi, Bluetooth, ZigBee, or LoRa.

* * * * *